US005113700A

United States Patent [19]

Coburn

[11] Patent Number: 5,113,700

[45] Date of Patent: * May 19, 1992

[54] BULLET TRAP

[75] Inventor: Ronald Coburn, Westfield, Mass.

[73] Assignee: Passive Bullet Traps Limited, Douglas, Isle of Man

[ * ] Notice: The portion of the term of this patent subsequent to Dec. 10, 2008 has been disclaimed.

[21] Appl. No.: 760,750

[22] Filed: Sep. 16, 1991

Related U.S. Application Data

[63] Continuation-in-part of Ser. No. 627,705, Dec. 14, 1990, Pat. No. 5,070,763.

[51] Int. Cl.[5] ..... F41J 1/14

[52] U.S. Cl. ..... 89/36.02; 273/410

[58] Field of Search ..... 273/410; 89/36.02

[56] References Cited

U.S. PATENT DOCUMENTS

| | | | |
|---|---|---|---|
| 385,546 | 7/1888 | Decumbus | 273/404 |
| 398,186 | 2/1889 | Rehfuss | 273/404 |
| 694,581 | 3/1902 | Reichlin | 273/404 |
| 840,610 | 1/1907 | Easdale | 273/404 |
| 2,013,133 | 9/1935 | Caswell | 273/410 |
| 3,737,165 | 6/1973 | Pencyla | 273/410 |
| 4,126,311 | 11/1978 | Wagoner | 273/410 |
| 4,728,109 | 3/1988 | Simonetti | 273/410 |
| 4,821,620 | 4/1989 | Cartee et al. | 89/36.02 |

FOREIGN PATENT DOCUMENTS

| | | | |
|---|---|---|---|
| 500781 | 6/1930 | Fed. Rep. of Germany | 273/410 |
| 6353 | of 1908 | United Kingdom | 273/410 |

*Primary Examiner*—David H. Brown
*Attorney, Agent, or Firm*—Norbert P. Holler

[57] ABSTRACT

A bullet trap, for catching a projectile fired from a firearm not more powerful than a .44 Magnum handgun, includes a passageway which has an entrance opening and a shallow exit opening or throat, bounded by upper and lower flat plates inclined to the horizontal at an angle of between 0° and about 15°, and a generally spiral-walled spent projectile energy-dissipating chamber which has a horizontal axis and communicates substantially tangentially with the passageway through the throat. The chamber wall has an initial part which is an upwardly curving extension of the lower plate and a terminal part which is located at the rear end of the upper plate, and the angle of inclination of the plates ensures that the projectile enters the chamber at a relatively low angle to the initial part of the chamber wall and moves along the latter without being shattered or damaging the wall. When the spent projectile ultimately falls off the terminal wall part onto the initial wall part, it moves back through the throat into the passageway and then to a collecting location. The trap may be provided with a liquid lubricant spray system in the chamber to enable spent projectiles, together with any lead dust that may be generated, to be engulfed and flushed along the lower plate to the collecting location.

26 Claims, 2 Drawing Sheets

BULLET TRAP

CROSS-REFERENCE TO RELATED APPLICATION

This application is a continuation-in-part of prior copending application Ser. No. 627,705 filed Dec. 14, 1990, now U.S. Pat. No. 5,070,763 issued Dec. 10, 1991. To the extent necessary for an understanding of the invention, the entire disclosure of the prior application is incorporated herein by this reference.

This invention relates to bullet traps, i.e., devices used to catch and stop bullets fired from rifles, shotguns, handguns, and the like in a firearm testing facility or a commercial firing range.

BACKGROUND OF THE INVENTION

Bullet traps per se are well known devices which have been used for many years by firearm manufacturers and users (the latter including firing ranges operated by military installations, police departments, rifle and pistol clubs, and the like) who are faced either with the need to proof, function fire and target firearms such as handguns, rifles and shotguns or with the task of simply collecting spent bullets fired on the range. In this context, "proof" means test firing a firearm at a higher load of ammunition, usually 40% greater, than the regular load specified for the barrel of that firearm; "function fire" means test firing the firearm through its full cycle of functions; and "target" means test firing the firearm for accuracy. The objectives of such devices have been to provide means located at a relatively short distance from the shooter to catch the lead or other types of bullets (jacketed or unjacketed) and prevent either the ricochet of a whole bullet or a large fragment thereof or the backsplattering of numerous small metal particles, which could return with enough energy to cause injury to the shooter or innocent bystanders, and to collect the waste lead, brass and jacket material. The known types of bullets traps have run the gamut from wood boards to sand-filled boxes to metallic funnel and deceleration chamber combinations, and their structural and functional characteristics as well as their drawbacks and disadvantages are set forth in the aforesaid prior application Ser. No. 627,705, to which reference may be had for the relevant details.

The bullet trap according to the invention disclosed in application Ser. No. 627,705, is designed to overcome those drawbacks and disadvantages and to be used with all types of manual firearms (including handguns, rifles, shotguns, elephant guns, and the like) and with all types of ammunition (up to and including armor-piercing bullets). To this end, the trap (like many of the known "funnel and chamber" types of traps) has a first pair of spaced flat metal plates located on opposite sides of the path of flight of a bullet being fired into the trap and a second pair of spaced flat metal plates arranged transverse to the first plates on opposite sides of the bullet flight path, with the two pairs of plates defining the respective sides of a passageway having at its front end an entrance opening and at its rear end an exit opening or throat through which the bullet can pass, and a spent bullet deceleration and energy-dissipating chamber the circumferential boundary wall of which is of generally spiral configuration and the opposite end walls of which are constituted by portions of the respective second plates, with the passageway communicating with the chamber substantially tangentially of the latter through the throat. In that trap, the basic novel features are that:

(a) the two first plates are made of ⅜-inch to ¾-inch thick sheets of high tensile steel, are located, respectively, above and below the path of flight of the bullet, and in order to minimize bouncing of the bullet are oriented at respective angles of inclination to the horizontal ranging from 0° to about 7°;

(b) the bullet deceleration and energy-dissipating chamber has a substantially horizontal axis, and the circumferential boundary wall thereof is defined by a curved extension of the lower one of the two first plates, with (i) an initial part of the chamber wall extending from the lower first plate generally rearwardly of the passageway first at an orientation to the horizontal substantially the same as that of the lower first plate and then arcuately upwardly relative to the latter, (ii) a middle part of the chamber wall extending arcuately from the initial part of the wall generally frontwardly of the passageway first upwardly and then downwardly, and (iii) a terminal part of the chamber wall extending arcuately from the middle part of the wall downwardly and again generally rearwardly of the passageway into substantially coplanar relation with the upper one of the two first plates and into overlying relation, at an end edge of the terminal part of the wall, to the region of the initial part thereof which is contiguous to the lower first plate;

(c) the chamber has no part the radius of curvature of which is less than 28 inches, which has been empirically determined to be appropriate to keep the maximum amount of the side of the bullet presented to the chamber wall during its travel along the initial part of the latter so that the shock of the bullet is distributed more evenly along the wall and over a larger surface area thereof and that tumbling of the bullet because of its nose digging into the chamber wall (which would occur were the radius of curvature of the wall smaller than 28 inches) is prevented; and (d) a spray nozzle arrangement is provided in the deceleration chamber for directing a liquid white water lubricant (consisting of, for example, 4 parts water and 1 part mineral oil) against the interior surface of the circumferential boundary wall of the deceleration chamber so as to flow downwardly into the passageway through the throat thereof and then along the lower first plate to a collecting vessel, for both (i) minimizing the metal to metal contact between the bullets and the metal surfaces along which they move, with the result that scoring and erosion of those surfaces as well as the generation of lead dust, if the bullets are made of lead, are reduced as far as possible, and (ii) ensuring that shells, casings, spent bullets, any lead dust that is generated, and even any fragments of a larger size that might split off from the bullets, are engulfed in the liquid and are flushed thereby along the lower first plate of the passageway and into the collecting vessel, with the spray nozzle system being interconnected with the collecting vessel by suitable piping and a pump so that the liquid lubricating fluid, after separation of solids therefrom, can be recirculated from the collecting vessel to the spray nozzle conduit.

The advantages of the bullet trap according to the invention disclosed in application Ser. No. 627,705 are manifold. Very significantly, the trap is relatively inexpensive to manufacture, can be constructed for transportability and ease of installation, and does not require the provision of thick walls, sand mounds or like backup structures. Also, the trap is multi-functional and permits proofing, function firing and targeting of handguns, shotguns and rifles (including high powered rifles) in one system, so that expenses that might have to be incurred in connection with the known types of bullet traps for providing duplicate separate systems for function firing, targeting and proof testing can be avoided. Moreover, whereas for safety reasons high powered rifles conventionally are test-fired only at outdoor long-distance firing ranges, the use of this trap permits test-firing of such rifles to be safely performed even in a relatively small room with a distance of only 75 feet or less between the muzzle of the gun and the trap. Also, since the trap can withstand even such high energy ammunition as 30.06 NATO armor-piercing bullets, 600-grain elephant gun bullets, and the like, wear and tear on the trap, maintenance requirements, and the need for periodic replacement of parts of the trap (in particular the upper and lower impact plates of the passageway and the circumferential boundary wall of the deceleration chamber) and the attendant costs thereof are all greatly reduced if not eliminated altogether. Still further, when a bullet is fired into the trap, any lead dust generated in the course of the movement of the bullet along the metal surfaces of the trap is inevitably, and without any possibility of escape from the system, engulfed by and entrapped in the liquid lubricant fluid sprayed out of the spray nozzles and continuously flowing downwardly over the chamber wall and from there on over the lower plate of the passageway, so that the lead dust is flushed by the liquid into the collecting vessel, where it settles out of the liquid and accumulates on the bottom of the vessel and hence cannot be dispersed from the vessel into the surrounding atmosphere. The so-achieved salvaging of the heretofore normally wasted lead dust for reuse in making bullets provides an economic benefit as well, which has not been achievable with any of the known bullet traps.

BRIEF DESCRIPTION OF THE INVENTION

By virtue of the fact that the trap according to the invention disclosed in application Ser. No. 627,705 is designed for use with all types of manual firearms and all types of ammunition, regardless of the power thereof, it is necessarily constructed of high strength steel and is a fairly large structure, with its length (from the entrance opening of the passageway to the back of the deceleration chamber) being between 8 and 12 feet, its maximum height (measured vertically from the bottom edge of the trap, exclusive of the legs, to the top of the deceleration chamber) being between 6 and 8 feet, and its width being between 2 and 3 feet, and with the size of the entrance opening preferably being (depending on the width of the trap) either 2'×2' (24"×24") or 3'×3' (36"×36"). For some uses, however, for example, in connection with relatively lower power firearms such as handguns up to 0.44 Magnum, 0.22 long rifles, and air guns, the trap may not need to be constructed of such strong structural materials and to have the indicated dimensions, and if the trap is to be used only with air guns firing non-lead steel pellets, it may also not need to be made with a liquid lubricant spray and flushing system since there will be no generation of lead dust to be concerned with.

It is thus the primary objective of the present invention to provide versions of the bullet trap disclosed in application Ser. No. 627,705 which are not intended for use with such high power firearms and ammunition as are there discussed but are well adapted for use with relatively lower power firearms and ammunition.

In particular, such a trap when designed for use with firearms not more powerful than a 0.22 long rifle, may be made of 3/16-inch thick high tensile steel sheet and may be 36 inches long, 28 inches high, and 13 inches wide, with the first and second plates being inclined at angles of about 12° to the horizontal starting from a 13"×13" entrance opening, and with the radii of curvature of the various parts of the deceleration chamber wall being on the order of only about 8 inches. In the case of a trap designed for use with handguns which are more powerful than 0.22 long rifles but in any event not more powerful than a 0.44 Magnum, the trap may be made of ¼-inch thick high tensile steel sheet and may be 50 inches long, 30 inches high, and 16 inches wide, with the first and second plates being inclined at angles of about 7° to the horizontal starting from a 16"×16" entrance opening, and with the radii of curvature of the various parts of the deceleration chamber wall being on the order of about 9 or 10 inches. Both of the foregoing types of trap are equipped with a liquid lubricant spray and circulating system for the deceleration chamber.

In the case of a trap designed for use with air guns, on the other hand, the trap, even though it could be made of metal, may instead be made of suitable self-lubricating plastics or comparable materials, e.g., nylon, polyethylene, polypropylene, polyvinyl chloride, graphite, and the like, which may be fiber-reinforced and/or otherwise treated with suitable additives as needed for enhancing their integrity. However, given the nature of the projectiles fired from air guns, there is obviously no risk of lead dust being generated, and thus the trap need not be equipped with a liquid lubricant flushing system; the self-lubricating nature of the construction material of the trap will ensure that frictional drag is minimized. The dimensions of such a trap, which may be a one-piece molded construction, may be basically the same as those of the other traps described above, except that the elements constituting the first and second plates may be inclined at angles of as much as 15° to the horizontal and that the radii of curvature of the various parts of the deceleration chamber, wall may be on the order of as little as about 6 inches or even less.

BRIEF DESCRIPTION OF THE DRAWINGS

The foregoing and other objects, characteristics and advantages of the present invention will be more clearly understood from the following detailed description thereof when read in conjunction with the accompanying drawings, in which.

DETAILED DESCRIPTION OF THE INVENTION

Figure 1:
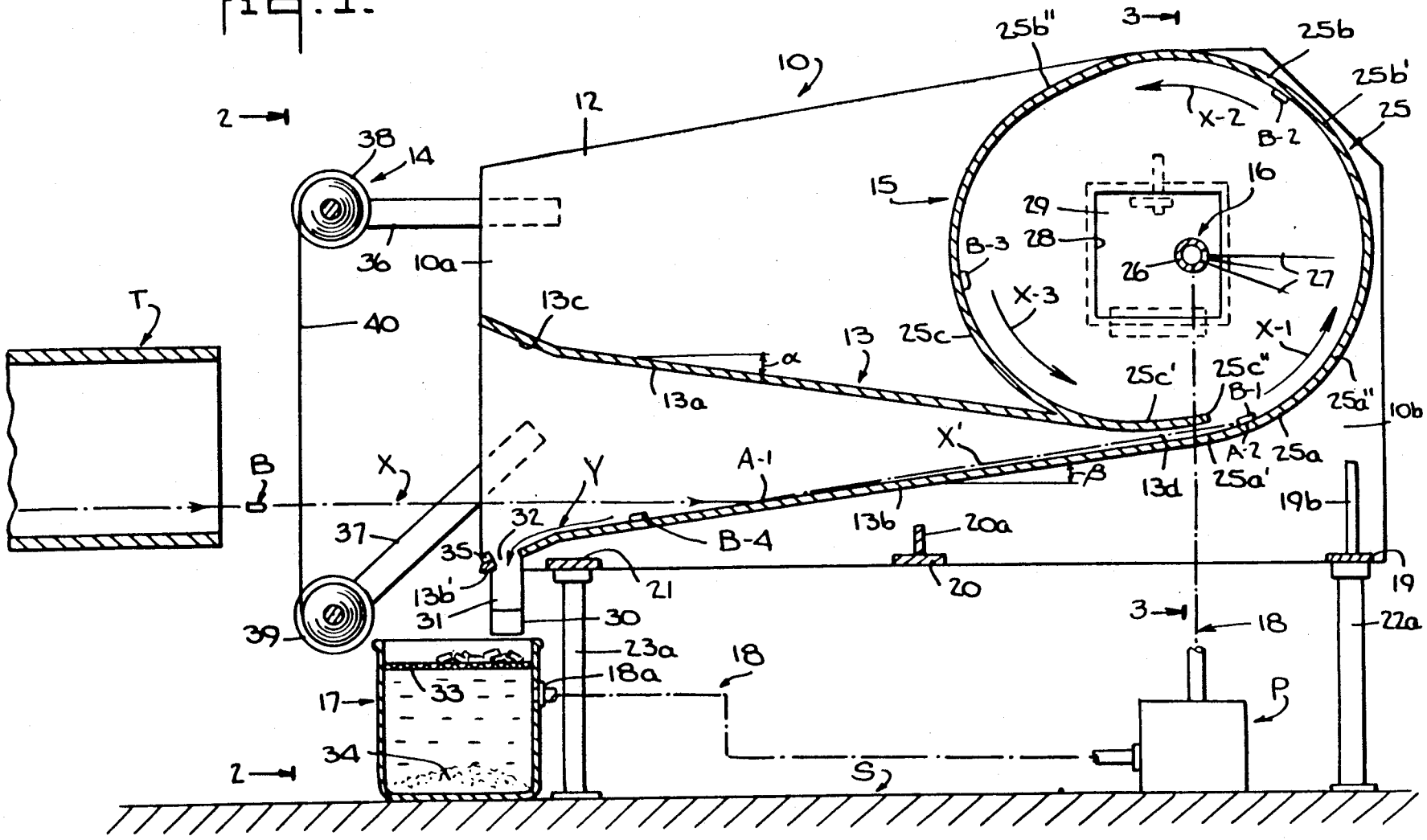
FIG. 1 is a longitudinal vertical section through a bullet trap according to the present invention.

Referring now to the drawings in greater detail, the bullet trap 10 according to the present invention is shown as including, between a pair of spaced elongated vertical side walls 11 and 12, a passageway structure 13 having upper and lower walls **13*a* and 13*b* and into the front end entrance opening 13*c* of which a projectile B, either a powder-discharged bullet or a BB, can be fired from a firearm (not shown) supported on a suitable test-firing stand (not shown) but including an aiming tube T the inner diameter of which is about 3 inches less than the height of the entrance opening 13***c*. The trap further includes at its front end a target positioning means 14 and at its rear end a generally spirally configured spent projectile deceleration and energy-dissipating chamber 15 the interior of which communicates substantially tangentially thereof with the interior of the passageway structure 13 through a shallow exit opening or throat 13*d* of the latter. The chamber 15 is shown as being equipped with a suitable spray nozzle means 16 for spraying a liquid lubricant onto a selected region of the interior wall surface of the chamber, although, as previously pointed out herein, in a trap made of plastics or the like and designed for use with air guns only, such a lubricant spray system is not necessary and can be dispensed with. A collecting vessel 17 for receiving liquid lubricant (if any) and solids discharged from the chamber and passageway structure is arranged under the lower wall 13*b* of the passageway structure at a suitable discharge location (e.g., adjacent the front end) thereof, and, when a spray system is used, a piping arrangement 18 incorporating a pump P is provided between the collecting vessel 17 and the spray nozzle means 16 for feeding liquid lubricant from the collecting vessel to the spray nozzle means.

The side walls 11 and 12 of the trap 10 (previously referred to herein as the second plates) are connected in any suitable manner at a plurality of longitudinally spaced locations (three are illustrated and have been found to be sufficient) to the opposite ends of respective horizontal cross beams 19, 20 and 21. Of these, the beams 19 and 21 are connected to and supported by respective pairs of vertical legs 22, 22*a* and 23, 23*a* adapted to stand on a suitable supporting surface S, for example, the ground or a floor of a room or basement of a building. Additional rigidity is imparted to the side wall structure of the trap by a pair of right triangular vertical stiffening plates 19*a*, 19*b* which are connected to the cross beam 19 and the proximate regions of the side wall plates 11 and 12, and by a rectangular vertical stiffening plate 20*a* which is connected along one longitudinal edge thereof to the cross beam 20 and at its opposite end edges to the proximate regions of the side wall plates 11 and 12.

The upper and lower walls 13*a* and 13*b* of the passageway structure 13 of the trap (previously referred to herein as the first plates) are connected at the respective opposite side edges thereof to the inwardly directed faces of the side wall-forming plates 11 and 12. The plates 13*a* and 13*b* are located above and below, respectively, the horizontal path of flight X of the projectile B. In the illustrated embodiment of the invention, the plates 13*a* and 13*b* are shown as being oppositely inclined relative to the horizontal at respective angles $\alpha$ and $\beta$ and as converging toward one another from the front end region 10*a* of the trap toward the rear end region 10*b* thereof, i.e., in the direction of flight of the projectile. The plates 13*a* and 13*b* thereby define a generally funnel-shaped passageway structure having a relatively wide entrance opening 13*c* at the front end and a relatively shallow throat or exit opening 13*d* at its rear end. The angles of inclination $\alpha$ and $\beta$ of the plates 13*a* and 13*b*, depending on the nature of the trap as determined by the types of firearms and ammunition with which it is designed to be used, lie between 0° and about 15° to the horizontal and preferably (but not necessarily) are equal to each other.

The deceleration chamber 15 of the trap 10, which has a horizontal axis, is located generally rearwardly of the passageway structure 13 and is defined between respective portions of the side wall-forming plates 11 and 12 in the rear end region 10*b* of the trap and a circumferential boundary wall 25 connected at its opposite side edges to the plates 11 and 12. The wall 25 in the illustrated embodiment of the trap is an extension of (i.e., of one piece with) the lower plate 13*b* of the passageway structure and has a generally spiral configuration.

In essence, the chamber wall 25 may be considered as having three distinct parts: (i) an initial part 25*a* which extends from the throat 13*d* generally rearwardly of the passageway structure, first at an angle of inclination to the horizontal substantially the same as that of the lower plate 13*b*, as shown at 25*a*', and then arcuately upwardly relative thereto, as shown at 25*a*"; (ii) a middle part 25*b* which extends arcuately from the initial part 25*a* generally frontwardly of the passageway structure, first upwardly, as shown at 25*b*', and then downwardly, as shown at 25*b*'; and (iii) a terminal part 25*c* which extends arcuately from the middle part 25*b* downwardly and generally rearwardly of the passageway structure into substantially coplanar relation, as shown at 25*c*', with the upper plate 13*a* of the passageway structure and has an end edge 25*c*" overlying the region 25*a*, of the initial part of the circumferential boundary wall 25 contiguous to the lower plate 13*b* but spaced from that region by about 1.5 to about 3 inches, i.e., at least the same as the height of the throat 13*d* of the passageway structure 13.

Of especial significance, in this connection, is the fact that the radii of curvature of the various parts of the circumferential boundary wall 25 of the deceleration chamber 15 are, depending on the nature of the trap and the types of firearms and ammunition with which it is designed to be used, generally not less than about 6 inches or greater than about 10 inches. The minimum magnitude of the radius of curvature in each case is what is empirically determined as being appropriate for the circumferential wall of the respective deceleration chamber so as to enable the same to function as a deflection plate for relatively gently turning the projectile B out of its pre-contact straight ahead trajectory to a curving path actually reversing its initial direction of flight, as indicated by the arrows X-1, X-2 and X-3 in FIG. 1. However, the radii of curvature of some regions of the wall 25 may be somewhat greater than the radius of curvature of one or more of the other parts of the wall, although it is not anticipated that the deviation from the stated minimum value of the radius of curvature in any given case will be more than about 10 to 15%.

Figure 3:
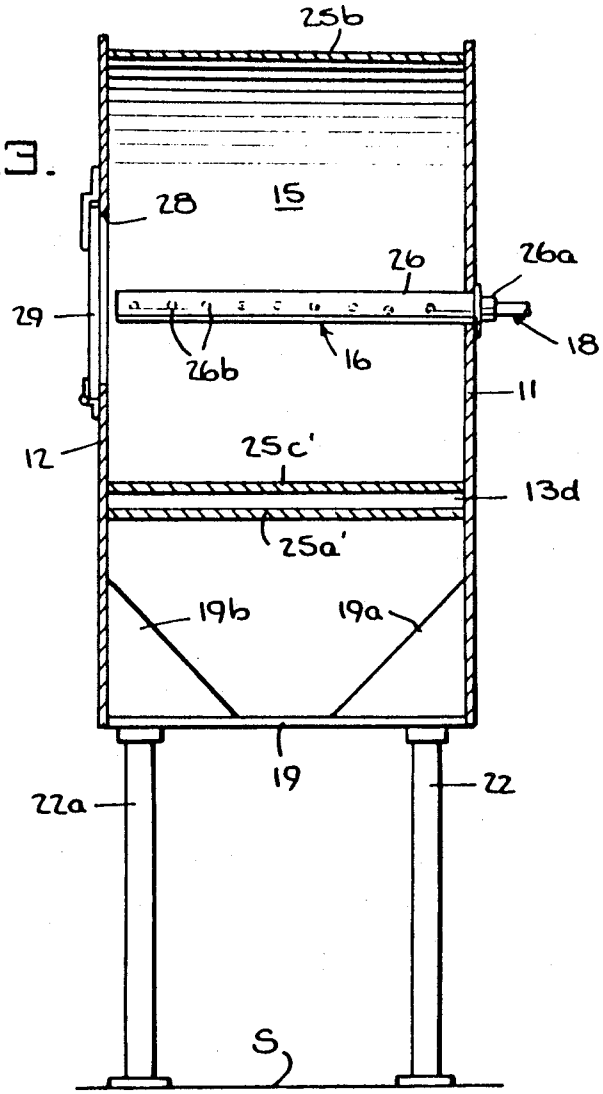
FIG. 3 is a sectional view taken along the line 3—3 in FIG. 1.

The spray nozzle means 16 (FIGS. 1 and 3), which will be used in any bullet trap designed for use with lead bullets, i.e., ammunition that is likely to lead to the generation of lead dust, for directing sprays or streams 27 of White water lubricant against the interior surface of the circumferential boundary wall 25 of the deceleration chamber 15 comprises a conduit or pipe 26 securely mounted at one end region 26*a* thereof in the side wall 11 and extending across almost the entire length of the chamber substantially parallel to the horizontal axis of the same. An opening 28 is provided in the side wall 12 of the trap generally at the level of the conduit 26 to permit access to the latter and to the interior of the chamber 15 for cleaning, repairs, etc., the opening being normally closed and sealed by a door or cover plate 29. The conduit 26 is provided with a series of orifices or nozzles 26*b* spaced from one another longitudinally of the conduit and facing toward the initial part 25*a* of the circumferential boundary wall of the chamber. While the exact positioning of the nozzles is not critical, it is preferred that they be arranged to direct the streams 27 of the liquid lubricant against the initial wall part 25*a* somewhere in the zone between the 3-o'clock and 5-o'clock positions, for example, at the zone between the 3-o'clock and 4-o'clock positions as indicated diagrammatically in FIG. 1.

The liquid lubricant is initially contained in the collecting vessel 17 and is fed therefrom to the conduit 26 via the piping 18, which is connected to the vessel 17 in its upper region by means of a fitting 18*a*, and the pump P incorporated in the piping. The collecting vessel, e.g., a 55-gallon steel drum, in the illustrated embodiment of the invention is located below the front end region 13*b*, of the lower plate 13*b* of the passageway structure 13, under a discharge chute 30 which communicates with the bottom outlet opening 31*a* (FIG. 2) of a trough 31 extending across the entire width of the front end region 10*a* of the trap, the trough being connected at its opposite ends to the side walls 11 and 12 of the trap and at its upper edges to the underside of the plate 13*b* and thus having its upper intake opening 31*b* located directly below a 2-inch or so wide slot-shaped opening 32 provided in the plate 13*b*. Alternatively, the collecting vessel may be located directly under the lower plate 13*b* within the confines of the trap and between the legs 23, 23*a* (not shown). In either case, a removable sieve or strainer member 33 is located in the upper region of the collecting vessel, preferably somewhat below its top rim, the openings of the strainer member being large enough to permit passage of liquid and of lead dust therethrough but small enough to cause bullets, large bullet fragments, shells and casings to be retained thereon.

Figure 2:
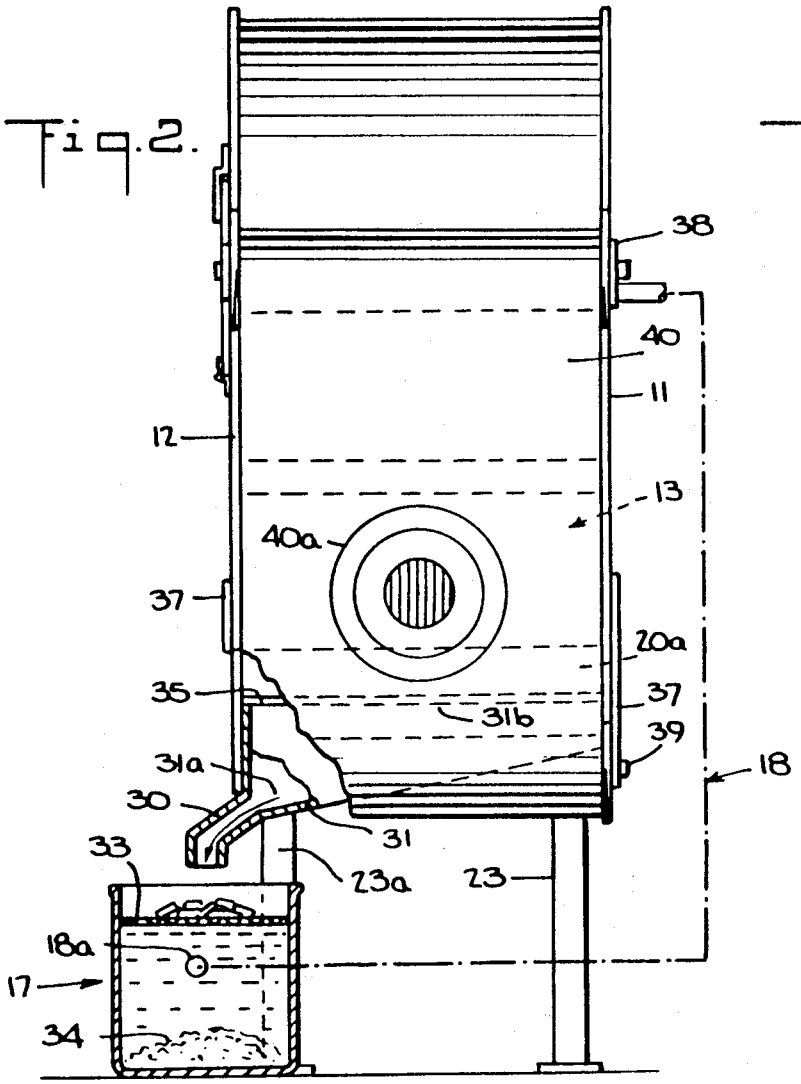
FIG. 2 is a front end elevational view of the trap with some parts being broken away and illustrated in section to show details, the view being taken along the line 2—2 in FIG. 1.

In the illustrated embodiment of the trap, the target positioning means 14 is shown as including a pair of upper arms 36 and a pair of lower arms 37 which are secured, in any suitable way, either permanently as by welding or other manner of bonding or removably as by means of rivets or bolts (not shown), to the outer surfaces of the side wall plates 11 and 12. The two pairs of arms are provided with journals or bearing means (not shown) for rotatably supporting the opposite ends of respective rolls 38 and 39 between which extends a band 40 of sheet material (e.g., paper). The band is wound on the rolls, with its opposite ends connected to the same, and is provided on that surface thereof which in the region between the rolls faces away from the trap and toward the shooter, with a multiplicity of target images 40*a* (only one is shown in FIG. 2). One of the rolls 38 and 39 is provided with drive means (not shown) for rotating it so as to enable the band to be drawn from the idler roll and wound up on the driven roll for the purpose of shifting a fresh target image into position in front of the entrance opening 13*c* of the passageway structure 13. The drive means for rotating the driven roll and advancing the band may be manually operatable, e.g., a crank handle connected to the roll axle, or remotely operatable, e.g., an electric motor connected (with or without suitable gearing) to the roll axle and adapted to be actuated by the shooter from his or her position. Alternatively, of course, target image-bearing boards or panels may be individually disposed in place in front of the entrance opening, e.g., with the aid of a stand or by hanging from the upper passageway plate 13*a* or otherwise (not shown).

The change in its flight path X which the projectile B will undergo after impacting against the lower plate 13*b* of the passageway structure 13 is diagrammatically illustrated in FIG. 1. Assuming that the initial flight path X is substantially horizontal, when the projectile impacts at some point A-1 against the plate 13*b*, it is deflected away therefrom, as indicated by the dot-dash line X', at a very small angle of about 1° or so to the lower plate 13*b*. Thus whether $\beta$ is 7°, 12° or 15°, the angle of inclination of the path X' to the horizontal is only about 1° i.e., about 8°, 13° or 16°, so that, as shown, the projectile never contacts the upper plate 13*a* and instead passes directly through the throat 13*d* of the passageway. It then comes into contact at point A-2 with the gently upwardly sloping region 25*a*'' of the initial part 25*a* of the circumferential boundary wall 25 of the deceleration chamber 15. Both these impacts are at such relatively low angles that the risk of damage or destruction of the plates 13*a*/13*b* and the initial part of the chamber wall 25 is effectively minimized. The same result would, of course, be achieved if the projectile were to contact the upper plate 13*a*, except that the path X' would then angle down from the plate 13*a*.

As previously mentioned, in the presently contemplated best mode of practicing the invention, the upper and lower plates 13*a* and 13*b* of the passageway structure 13 are inclined at respective angles of up to about 15° to the horizontal. It should be understood, however, as previously pointed out herein, that it is also within the contemplation of the present invention that the angle of inclination of either or both of the plates 13*a* and 13*b* to the horizontal may be much smaller. For example, an orientation of the upper and lower plates of the passageway structure 13 at angles of inclination $\alpha$ and $\beta$ as small as about 1° or 2° is even more effective in avoiding a shattering of projectiles upon impact than an orientation at a 15° angle or, as in the trap according to the invention disclosed in application Ser. No. 627,705, at a 7° angle. Actually, an angle of inclination of 0° (at which the plates 13*a* and 13*b*, strictly speaking, are not inclined but rather are parallel to the horizontal and each other) is still better from the standpoint of avoiding shattering of the projectiles, because of the greater possibility that a properly aimed projectile fired into the passageway structure will travel straight through the latter and into the deceleration chamber without contacting either of the upper and lower plates 13*a* and 13*b*.

The utilization of such low-angle orientations of the upper and lower impact or deflection plates of the passageway structure is, nonetheless, counterindicated by practical considerations. To begin with, it must be kept in mind that the desired height of the throat or exit opening 13*d* of the passageway structure 13 is about 1.5 inches to about 3 inches at most, and preferably not more than about 2 inches. As a consequence, an orientation of the plates 13*a* and 13*b* at angles of inclination of 2° or less would entail providing an entrance opening for the passageway structure almost as small as the exit opening. Thus, assuming the length of the passageway to be 3.0 feet (36 inches) from the entrance opening 13*c* to the exit opening 13*d* thereof, and assuming the throat to be 2 inches high, then positioning the upper and lower passageway plates 13*a* and 13*b* at an angle of inclination of either 1° or 2° to the horizontal would provide an entrance opening of a height of about 3.25 or 4.5 inches, which would leave very little margin for error in the aiming of the firearm. Positioning o the muzzle of the firearm being fired almost directly adjacent or even in such a small entrance opening 13*c* of the passageway structure would, of course, minimize and perhaps even totally eliminate the risk of the bullet missing that opening. However, even though such a positioning of the firearm might well be tolerable for purposes of proofing or function firing of the firearm, it would not be an acceptable practice for the purpose of target testing, which requires that the muzzle of the firearm be located a substantial distance, e.g., at least about 75 feet, from the bullet trap to enable the projectile to stabilize as it moves in its path of flight before it reaches the location of the target in front of the trap.

It is these considerations, therefore, which make it preferable to orient the upper and lower plates 13*a* and 13*b* of the passageway structure at angles of inclination of up to 15° to the horizontal. At a 12° or 15° angle of inclination of the two plates of a 3-foot long passageway structure 13 terminating in a 2-inch- high throat, the entrance opening is approximately 17.3 or 21.3 inches in height, which goes a long way toward eliminating the risk of the projectile missing the passageway altogether even when the firearm is being targeted.

It will be apparent from the foregoing that the term "angle of inclination" as used in this application is intended to designate, and should be interpreted as designating, any orientation of the plates 13*a* and 13*b* at an angle within the range of 0° to 15° to the horizontal.

It will be understood, therefore, that when a projectile B is fired into the trap and impacts against one of the passageway boundary plates, for example, against the lower plate 13*b* of the passageway structure 13, it will lose a small part of its energy o by virtue of that first contact. Thereafter, the projectile continues substantially unimpeded into the deceleration chamber. It should be noted, however, that although in any trap according to the present invention which is made of metal and is equipped with a liquid lubricant spray and circulating system, the presence of the lubricant in the passageway and the deceleration chamber does serve to reduce to a great degree the frictional metal to metal contact between the projectile and the plate or plates it contacts, it does not eliminate frictional effects altogether. Accordingly, where the projectile is a bullet made of lead (as probably 90% of all bullets are), there will be a certain amount of lead dust generated which, were it to escape into the atmosphere, would pose a major health and environmental hazard. However, because that lead dust is simultaneously with its formation engulfed in the flowing liquid lubricant and entrained thereby to move therewith toward the collecting vessel 17, the lead dust cannot escape. Moreover, as the lubricant flows into the vessel 17, the lead dust, being considerably heavier than the liquid, almost immediately settles to the bottom of the vessel and accumulates there, as indicated at 34.

This action, as can be seen, has two direct and highly advantageous consequences apart from the ecological benefit mentioned above. One is of operational significance, in that the quantity of liquid located in the vessel 17 above the accumulated lead dust 34 is effectively self-cleaned, and thus when the liquid is extracted from the upper region of the vessel and recirculated through the piping 18 and the pump P to the spray nozzle means 16, it does not contain any lead dust and clogging of the pump and the nozzles 26*b* is avoided. The other is of economic significance, in that the system provides an automatic conservation and salvaging of the lead dust as a raw material. Thus, when enough lead dust has accumulated in the collecting vessel to make it appropriate to remove it, the pump is deactivated, the fitting or valve cock 18*a* is closed, the piping is disconnected therefrom, and the vessel is covered and sealed, preferably after the strainer member and its accumulated debris have been removed, and is transported to a suitable location where, under appropriate environmental safeguards, the lead dust can be separated from the liquid remaining in the vessel and processed for reuse in manufacturing bullets.

It is worthy to note, at this point, that in any bullet trap according to the present invention which is made of metal, the confinement of the lead dust to the interior of the trap and to the path of flow of the stream of liquid lubricant is assured by the welding of the various plates 11, 12, 13*a* and 13*b*/25 to each other which, apart from serving to rigidify and strengthen the structure of the trap, also provides the same with liquid-tight seals at all junctures between the plates. On the other hand, in any trap made of plastics or the like and designed for use with air guns firing steel (non-lead) BB's or pellets, the provision of the liquid lubricant spray and circulating system can, as previously pointed out, be dispensed With, since frictional drag is minimized by the self-lubricating nature of the materials of which the trap is made. Even so, however, the trap is preferably constructed with full seals at all junctures, achieved by forming the trap as a one-piece molding or by suitably bonding or fusing the various plates to one another with the aid of heat, adhesives or other bonding agents, which apart from serving to rigidify and strengthen the structure of the trap, also aids in preventing the escape of any BB's or pellets fired into the trap.

Reverting now to the bullet or BB entering the trap, the residual energy of the same, after it has passed through the throat or exit opening 13*d* of the passageway structure, is dissipated as the bullet or BB circumnavigates the deceleration chamber 15. The spent bullet or BB ultimately falls off the terminal part 25*c* of the chamber wall 25 and over the end edge 25*c*" thereof onto the initial part 25*a* of the wall 25 contiguous to the lower plate 13*b* of the passageway structure 13. From there, the bullet or BB rolls or slides through the throat 13*d* along the plate 13*b*, as indicated at B-4 and by the arrow Y in FIG. 1, toward the discharge region thereof. This movement occurs to a certain extent by dint of the force of gravity and, in the event a liquid lubricant has been sprayed against the initial part 25*a* of the chamber wall, is assisted by the liquid as it flows downwardly along the chamber wall and thence through the throat 13*d* and along the lower plate 13*b* of the passageway structure 13 toward the front of the trap. In the case of the "wet" trap, the liquid finally drops through the opening 32 into the trough 31 and thence into the collecting vessel 17. A transverse ridge or plate 35 is provided atop the end portion 13*b*' of the plate 13*b* at the downstream edge of the opening 32 to constitute a barrier for deflecting the liquid and the bullets, bullet fragments, shells and casings descending along the plate 13*b* into the opening 32 and inhibiting their passage over the plate end portion 13*b*'. In the case of the "dry" trap, on the other hand, the BB or pellet may also be permitted to drop through the opening 32 in the lower plate 13*b* and into a collecting vessel positioned thereunder, but alternatively the provision of the opening may be dispensed with and the BB or pellet simply brought to a halt by the ridge 35.

The white water lubricant, apart from its lubricating and flushing functions, also affords yet another advantage, in that it adds a measure of soundproofing to the trap. In fact, it has been found that the noise level of bullets traveling through the trap is as much as 10 db less in the presence of the liquid than in its absence, because the white water absorbs vibrations and harmonics resulting from the impacts of the bullets against and their movements along the plates 13*a* and 13*b* of the passageway structure and the circumferential boundary wall 25 of the deceleration chamber 15.

As presently contemplated, the space requirements for the traps of the present invention are relatively minimal. Thus, the length of such a trap from its front end edge (exclusive of any target positioning means) to its rear end edge preferably is not more than approximately 35 to 50 inches, the height of the trap from its bottom edge (exclusive of the legs of the trap) to its top edge at the region of maximum height of the deceleration chamber preferably is not more than approximately 28 to 30 inches, and the width of the trap preferably is not more than about 13 to 16 inches. The height of the trap on its legs is about 74 inches but may be somewhat more or less than that. Any such trap, furthermore, weighs less than 500 lbs. (in the case of a trap made of plastics, the weight will most likely be less than 200 lbs.) and thus is able to be readily moved from one location to another, while nevertheless being fully stable when in use. It should also be noted that the particular "ramp angle" (the angle of inclination of the passageway plates 13*a* and 13*b*) selected for any given trap of the present invention will in general depend on the type of ammunition, that is to say, the weight and velocity of the projectile, to be fired into it. Thus, a 15° angle is acceptable for BB's or pellets fired from air guns, but angles of 12° or less (down to about 7°) would be more appropriate for powder-discharged bullets.

It will be understood that the foregoing description of preferred embodiments of the present invention is for purposes of illustration only, and that the various structural and operational features herein disclosed are susceptible to a number of modifications and changes none of which entails any departure from the spirit and scope of the present invention as defined in the hereto appended claims.

I claim:

1. A bullet trap for catching and deenergizing projectiles fired along a substantially horizontal path of flight into the trap from manual firearms not more powerful than a 0.44 Magnum handgun, which trap includes a first pair spaced flat plates located on opposite sides of said path of flight and a second pair of spaced flat plates arranged transverse to said first plates on opposite sides of said path of flight, with said plates defining the respective sides of a passageway having at its front end an entrance opening and at its rear end a throat through which the projectiles can pass, and a spent projectile decelerating and energy-dissipating chamber the circumferential boundary wall of which is of generally spiral configuration and the opposite end walls of which are constituted by portions of said second plates, with said passageway communicating with said chamber substantially tangentially of the latter through said throat; the improvement comprising that:

(a) said first plates (i) are located, respectively, above and below said path of flight and (ii) are oriented at respective angles of inclination of between 0° and about 15° to the horizontal; and (b) said decelerating and energy-dissipating chamber has a substantially horizontal axis between said opposite end walls, and said circumferential boundary wall of said chamber is defined by a curved extension of the lower one of said first plates, (i) an initial part of said circumferential boundary wall extending from said throat generally rearwardly of said passageway first at an inclination to the horizontal substantially the same as that of said lower first plate and then arcuately upwardly relative thereto, (ii) a middle part of said circumferential boundary wall extending arcuately from said initial part generally frontwardly of said passageway first upwardly and then downwardly, and (iii) a terminal part of said circumferential boundary wall extending arcuately from said middle part downwardly and generally rearwardly of said passageway into substantially coplanar relation with the upper one of said first plates and having an end edge overlying the region of said initial part of said circumferential boundary wall contiguous to said lower first plate;

whereby a projectile fired into said passageway through said entrance opening along said path of flight and coming into contact with one of said first plates is deflected thereby through a small angle into a flight path running generally along the contacted first plate but out of contact therewith and ultimately passes through said throat of said passageway and impacts against said initial part of said circumferential boundary wall of said chamber at a relatively low angle so as not to be shattered thereby nor to damage the same, and the projectile then circumnavigates the chamber with gradually decreasing speed while in contact with said circumferential boundary wall until the energy of the projectile has been substantially dissipated, so that the spent projectile ultimately falls from said thermal part of said circumferential boundary wall over said end edge thereof onto said initial part of said circumferential boundary wall just rearwardly of said throat of said passageway and moves through said throat back into said passageway and along said lower first plate for removal from the trap.

2. A bullet trap as claimed in claim 1; wherein said circumferential boundary wall of said chamber at no part thereof has a radius of curvature which is less than about 6 inches.

3. A bullet trap as claimed in claim 1; wherein said circumferential boundary wall of said chamber at no part thereof has a radius of curvature which is greater than about 10 inches.

4. A bullet trap as claimed in claim 3; wherein said circumferential boundary wall of said chamber at no part thereof has a radius of curvature which is less than about 6 inches.

5. A bullet trap as claimed in claim 1; wherein, for catching a bullet fired from a firearm not more powerful than a 0.22 long rifle, said first and second plates and said circumferential boundary wall of said chamber are made of high tensile steel sheet, spray nozzle means are provided within said chamber for spraying a liquid lubricating fluid against said initial part of said circumferential boundary wall of said chamber so as to flow downwardly along said initial part of said circumferential boundary wall and thence through said throat and said passageway along said lower first plate to a discharge location of the latter, and the angle of inclination of at least one of said first plates to the horizontal is about 12°.

6. A bullet trap as claimed in claim 5; wherein the angle of inclination of said lower first plate to the horizontal is about 12°, the inclination of said lower first plate being upward in the direction from said entrance opening to said throat.

7. A bullet trap as claimed in claim 5; wherein the angles of inclination of said first plates to the horizontal are about 12° in opposite senses, with said first plates converging toward each other in the direction from said entrance opening to said throat.

8. A bullet trap as claimed in claim 5; wherein the radii of curvature of the various parts of said circumferential boundary wall of said chamber are on the order of about 8 inches.

9. A bullet trap as claimed in claim 8; wherein the angle of inclination of said lower first plate to the horizontal is about 12°, the inclination of said lower first plate being upward in the direction from said entrance opening to said throat.

10. A bullet trap as claimed in claim 8; wherein the angles of inclination of said first plates to the horizontal are about 12° in opposite senses, with said first plates converging toward each other in the direction from said entrance opening to said throat.

11. A bullet trap as claimed in claim 1; wherein, for catching a bullet fired from a firearm not more powerful than a 0.44 Magnum handgun, said first and second plates and said circumferential boundary wall of said chamber are made of high tensile steel sheet, spray nozzle means are provided within said chamber for spraying a liquid lubricating fluid against said initial part of said circumferential boundary wall of said chamber so as to flow downwardly along said initial part of said circumferential boundary wall and thence through said throat and said passageway along said lower first plate to a discharge location of the latter, and the angle of inclination of at least one of said first plates to the horizontal is about 7°.

12. A bullet trap as claimed in claim 11; wherein the angle of inclination of said lower first plate to the horizontal is about 7°, the inclination of said lower first plate being upward in the direction from said entrance opening to said throat.

13. A bullet trap as claimed in claim 11; wherein the angles of inclination of said first plates to the horizontal are about 7° in opposite senses, with said first plates converging toward each other in the direction from said entrance opening to said throat.

14. A bullet trap as claimed in claim 2; wherein the radii of curvature of the various parts of said circumferential boundary wall of said chamber are on the order of about 9 inches.

15. A bullet trap as claimed in claim 14; wherein the angle of inclination of said lower first plate to the horizontal is about 7°, the inclination of said lower first plate being upward in the direction from said entrance opening to said throat.

16. A bullet trap as claimed in claim 14; wherein the angles of inclination of said first plates to the horizontal are about 12° in opposite senses, with said first plates converging toward each other in the direction from said entrance opening to said throat.

17. A bullet trap as claimed in claim 1; wherein, for catching a BB or pellet fired from a firearm not more powerful than an air gun, the angle of inclination of at least one of said first plates to the horizontal is about 15°.

18. A bullet trap as claimed in claim 17; wherein the angle of inclination of said lower first plate to the horizontal is about 15°, the inclination of said lower first plate being upward in the direction from said entrance opening to said throat.

19. A bullet trap as claimed in claim 17; wherein the angles of inclination of said first plates to the horizontal are about 15° in opposite senses, with said first plates converging toward each other in the direction from said entrance opening to said throat.

20. A bullet trap as claimed in claim 17; wherein said first and second plates and said circumferential boundary wall of said chamber are made of plastics or graphite.

21. A bullet trap as claimed in claim 20; wherein the angle of inclination of said lower first plate to the horizontal is about 15°, the inclination of said lower first plate being upward in the direction from said entrance opening to said throat.

22. A bullet trap as claimed in claim 20; wherein the angles of inclination of said first plates to the horizontal are about 15° in opposite senses, with said first plates converging toward each other in the direction from said entrance opening to said throat.

23. A bullet trap as claimed in claim 17; wherein the radii of curvature of the various parts of said circumferential boundary wall of said chamber are on the order of about 6 inches.

24. A bullet trap as claimed in claim 23; wherein the angle of inclination of said lower first plate to the horizontal is about 15°, the inclination of said lower first plate being upward in the direction from said entrance opening to said throat.

25. A bullet trap as claimed in claim 23; wherein the angles of inclination of said first plates to the horizontal are about 15° in opposite senses, with said first plates converging toward each other in the direction from said entrance opening to said throat.

26. A bullet trap as claimed in claim 23; wherein said first and second plates and said circumferential boundary wall of said chamber are made of plastics or graphite.

* * * * *

UNITED STATES PATENT AND TRADEMARK OFFICE

CERTIFICATE OF CORRECTION

PATENT NO. : 5,113,700

DATED : May 19, 1992

INVENTOR(S) : Ronald Coburn

It is certified that error appears in the above-identified patent and that said Letters Patent is hereby corrected as shown below:

Column 6, line 24, for "25b'" read -- 25b" --; line 30, for "25a," read -- 25a' --; line 61, for "White" read -- white --. Column 7, line 21, for "13b," read -- 13b' --. Column 5, line 16, for "1° i.e." read -- 1° more, i.e. --. Column 9, line 4, for "Positioning o" read -- Positioning --; line 23, for "2-inch-" read -- 2-inch --; line 37, for "energy o" read -- energy --. Column 10, line 29, for "With" read -- with --. Column 13, line 59, for "claim 2" read -- claim 11 --.

Signed and Sealed this

Ninth Day of November, 1993

*Attest:*

*Attesting Officer*

BRUCE LEHMAN

*Commissioner of Patents and Trademarks*